US005152535A

United States Patent [19]

Roberts

[11] Patent Number: 5,152,535

[45] Date of Patent: Oct. 6, 1992

[54] BIBLE QUIZ GAME

[76] Inventor: Adolph Roberts, 26B Debs Pl., Bronx, N.Y. 10475

[21] Appl. No.: 804,899

[22] Filed: Dec. 6, 1991

[51] Int. Cl.[5] ..... A63F 3/00

[52] U.S. Cl. ..... 273/249; 273/431; 273/288

[58] Field of Search ..... 273/242, 243, 248, 249, 273/429, 430, 431, 432, DIG. 288

[56] References Cited

U.S. PATENT DOCUMENTS

| | | | |
|---|---|---|---|
| D. 252,344 | 7/1979 | Parker et al. | D21/22 |
| 1,695,144 | 12/1928 | Edwards | 273/249 |
| 4,121,823 | 10/1978 | McBride | 273/249 |
| 4,201,388 | 5/1980 | Cantelon | 273/251 |
| 4,566,698 | 1/1986 | Sneden | 273/249 |
| 4,807,878 | 2/1989 | Tripp | 273/431 |
| 4,934,709 | 6/1990 | Peterson | 273/249 |
| 4,984,805 | 1/1991 | Medlock | 273/248 |
| 5,042,816 | 8/1991 | Davis et al. | 273/431 X |
| 5,071,133 | 12/1991 | Smith | 273/291 X |
| 5,092,606 | 3/1992 | Miller | 273/249 |

*Primary Examiner*—Theatrice Brown
*Assistant Examiner*—William E. Stoll
*Attorney, Agent, or Firm*—Richard C. Litman

[57] ABSTRACT

A Bible Quiz Game including a game board divided into four equal playing sections, each section having an easier wide gate path and a harder strait gate path, each path having seven steps leading to a Circle of Glory, each player selecting one of the two paths, a pouch having three red marbles and one black marble therein, the marbles forming lots to identify the first player, four distinct pairs of shoes provided to identify each player's progress, a wide gate deck of cards and a strait gate deck of cards, the cards including biblical questions, negative accusations, freeze cards, mercy cards, a draw lot card, and instructions regarding movement of the shoes on the respective paths, the players selecting cards and following instructions sequentially in clockwise rotation. The first player to reach the Circle of Glory is declared the winner. An opposing player can temporarily block a players entry into the Circle of Glory with a freeze card.

16 Claims, 4 Drawing Sheets

FIG. 2
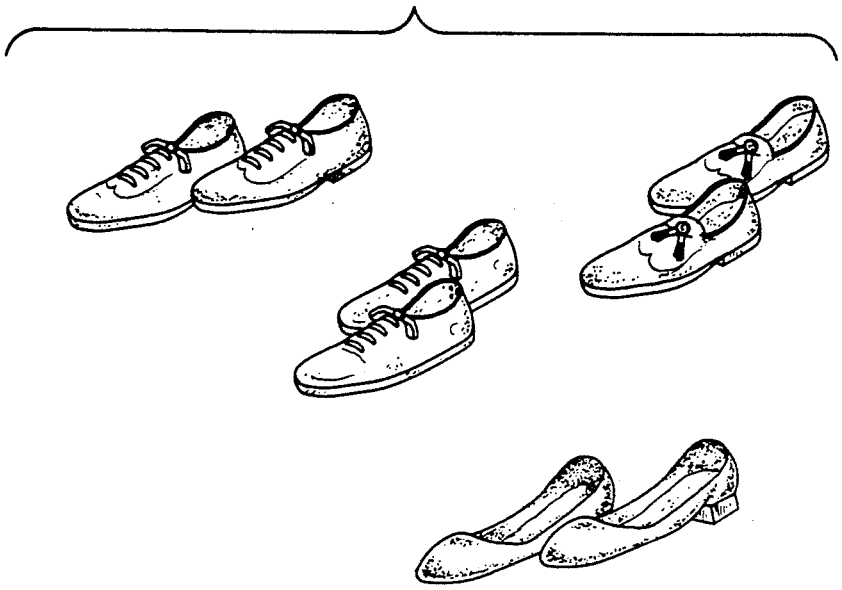
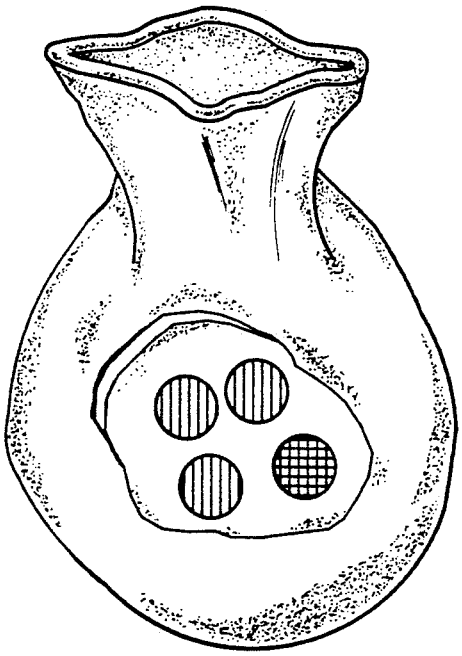
FIG. 3
FIG. 4
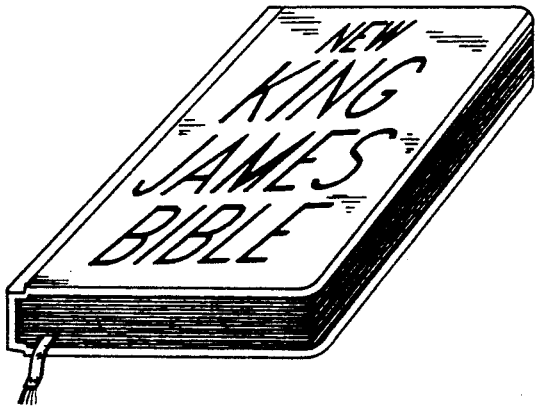

26 WIDE GATE CARDS

Name the prophet who baptized Jesus ?
Mathew 3:13
(C) Move one step upward
(I) move two steps down Where was Jesus Born ?
Mathew 2:1
(C) Move one step upward
(I) move two steps down You are guilty of fighting for no good reason move two steps down or draw a lot.
(S) Move one step down
(U) Move three steps down Draw Lot Card
(S) Move two steps upwards.
(U) Move two steps down You are guilty of gluttonous behavior.
Move two steps down You were accused of being drunk last night. Draw lot.
if (S) Remain in place.
if (U) Move two steps down.

Freeze Card Hold Until Nedded
This card will stop player who is standing...
...Stold to make an upward move.

Mercy Card
You prayed for forgiveness if you are sincere.
Draw lot.
(S) Move directly to a life of Holiness.
(U) Remain in place

30

FIG. 5

24 STRAIT GATE CARDS

The guilty man in a dispute could be given by the judge a maximum beating of. (Duet 25:1-3)
(a) 10 stripe (b) 20 stripe
(c) 40 stripe (d) 60 stripe
(C) Move one step upwards
(I) Remain in place Dietary laws were evidently, in Paul's view (1 Tim 4:1-3)
(a) necessary (b) acceptable
(c) regrettable (d) harmful
(C) Move one step upward
(I) Remain in place You are guilty of fighting for no good reason. Move one step down or draw a lot.
(S) Remain in place.
(U) Move two steps down.

Draw Lot Card
(S) Move two steps upwards.
(U) Move two steps down

You are guilty of gluttonous behavior.
Move two steps down

You were accused of being drunk last night. Draw lot.
if (S) Remain in place.
if (U) Move two steps down.

Freeze Card Hold Until Nedded
This card will stop player who is standing...
...Stold to make an upward move.

Mercy Card
You prayed foforgiveness if you are sincere.
Draw lot.
(S) Move directly to a life of Holiness.
(U) Remain in place

30

FIG. 6

BIBLE QUIZ GAME

BACKGROUND OF THE INVENTION

1. Field Of The Invention

This invention relates to an educational game, and more particularly to a Bible Quiz Game wherein the success of each participant depends partly on his or her knowledge of the Bible, and partly on chance.

2. Description Of The Related Prior Art

Educational games which require and/or teach knowledge of the Bible are known in the prior art. U.S. Pat. No. Des. 252,344, issued to William E. Parker et al on Jul. 10, 1979, discloses an ornamental design for a biblical game board. U.S. Pat. No. 4,201,388, issued to Ruth F. Cantelon on May 6, 1980, discloses a game apparatus including a game board having a plurality of paths, a marker for each player, each marker initially carrying a symbolic burden, or a shield or a crown, change indicating means, and corresponding sets of questions and answer cards, the question cards containing biblical quotations, with key words deleted therefrom and possible answer words provided therebelow, the answer cards indicating the correct words to be filled into the quotations. U.S. Pat. No. 4,121,823, issued Oct. 24, 1978 to Tarrie A. McBride, and U.S. Pat. No. 4,934,709, issued Jun. 19, 1990 to Kevin P. Peterson, are further representatives of educational game boards in which the respective players follow a path around the perimeter of a game board. U.S. Pat. No. 4,984,805, issued Jan. 15, 1991 to Nancy P. Medlock discloses an educational game board in which each of the three players follows a path from the perimeter of the game board towards the center of the board, while a fourth player is put in charge of question and answer cards.

SUMMARY AND OBJECTS OF THE INVENTION

None of the aforesaid cited references is seen to disclose the invention described and claimed below. The invention is directed to a Bible quiz game which tests each player's knowledge of the Bible. The game comprises a game board designed for up to four players, each of whom must climb seven steps to Glory by following instructions found on decks of cards which include question cards, negative accusation cards, freeze cards, mercy cards, and a draw lot card. The cards are divided into two groups, Wide Gate Cards and Strait Gate Cards. The strait gate cards generally have the most difficult questions, while the wide gate cards generally have easier questions. Each deck includes 50 cards, and a second deck in each category can be provided to be used alternately. Once a player has selected a category he or she is expected to continue selecting cards from the same category throughout the game. The first player to enter the circle of glory is declared the winner.

Also provided is a small pouch which includes 4 lots in the form of three red marbles and one black marble. The players draw lots, with the black marble determining which player will start first. The remaining players play in sequence in a clockwise direction. As each player selects a card, that card will determine the move that player will make. Once a player reaches the seventh step (Life of Holiness) he or she must wait until his or her next turn before entering into glory. If any of his or her opponents picks a card that instructs that person on the seventh step to freeze, that lead player must then, when his or her turn comes, select another card and follows its instruction.

Also, no player can advance beyond the seventh step without waiting until his or her ext turn and drawing a successful lot before entering "Glory". If the player on the sixth step (Separated by Faith) selects a card that instructs him or her to move two steps, he or she cannot move and must wait for his or her next turn and hope to select a card that moves him or her one space only. This is the only time a player is not able to comply with the selected cards instructions.

All cards with questions, will include the chapter and the verse having the correct answer in the New King James version of the Bible, which may be included with the game board.

Also included are four paris of shoes, each pair being of a different color and/or configuration and sized to be locatable with a step so as to indicate the progress of each player.

Accordingly, it is an object of this invention to provide an educational game involving biblical knowledge.

It is another object of this invention to provide an educational game having at least two degrees of difficulty enabling players with varying degrees of biblical knowledge to compete effectively against one another.

It is still another object of this invention to provide an educational game designed to introduce the New King James version of the Bible.

It is a still further object of this game to provide a Bible Quiz Game which may be played by the entire family.

Other objects, features and advantages of this invention will become apparent from the following detailed description and the appended claims, reference being had to the accompanying drawings forming a part of the specification, wherein like reference numerals designate corresponding parts of the several views.

BRIEF DESCRIPTION OF THE DRAWINGS

FIG. 2 is a perspective view of four pairs of shoes having different configurations for indicating each players progress on the game board.

FIG. 3 is a perspective partially cut-away view of a pouch containing four lots in the form of colored marbles.

FIG. 4 is a perspective view of the New King James version of the Bible.

FIG. 5 shows a representative sample of wide gate cards.

FIG. 6 shows a representative sample of strait gate cards.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description and not limitation.

Figure 1A:
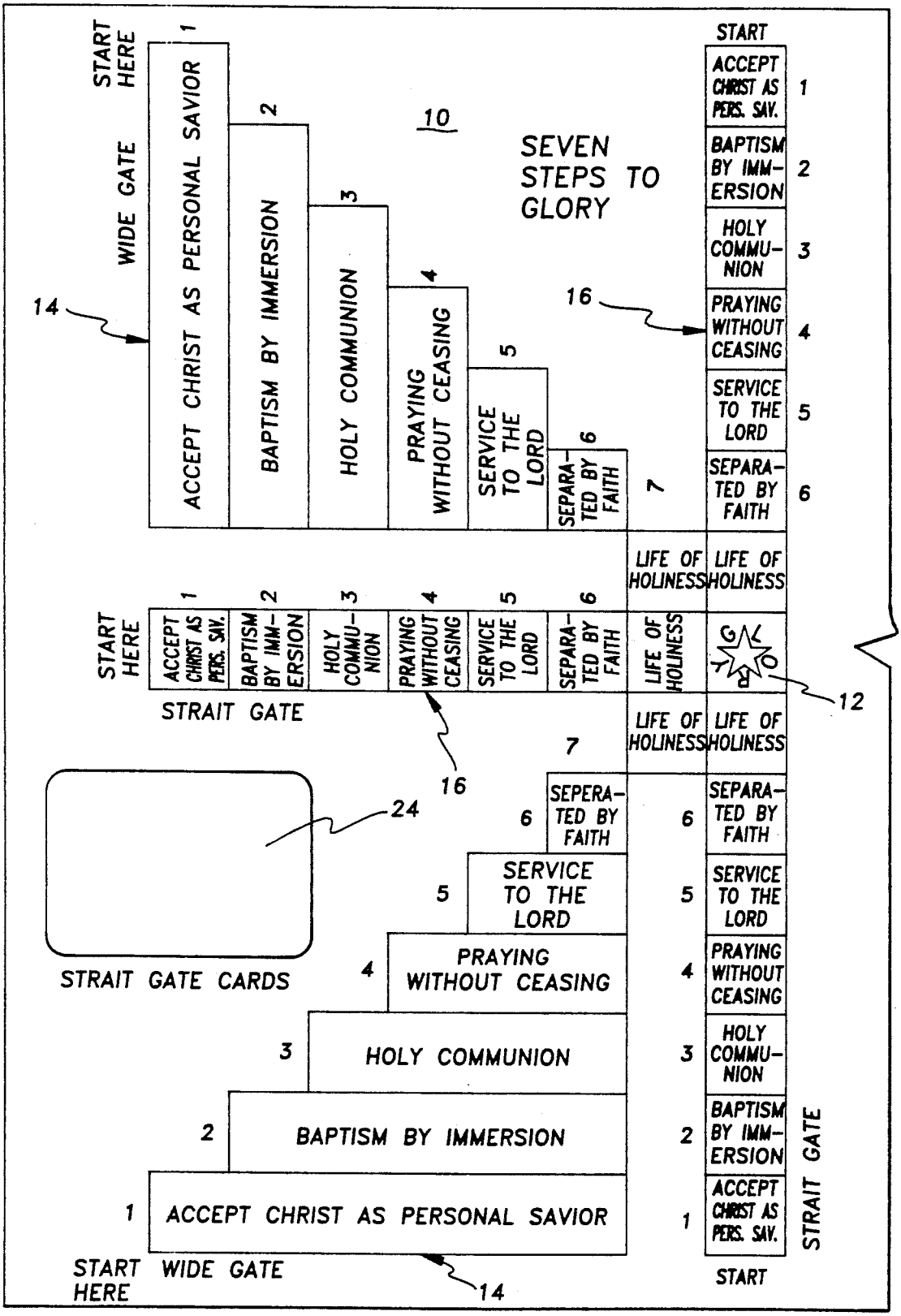
FIG. 1A and 1B taken together show a top view of the game board.
Figure 1B:
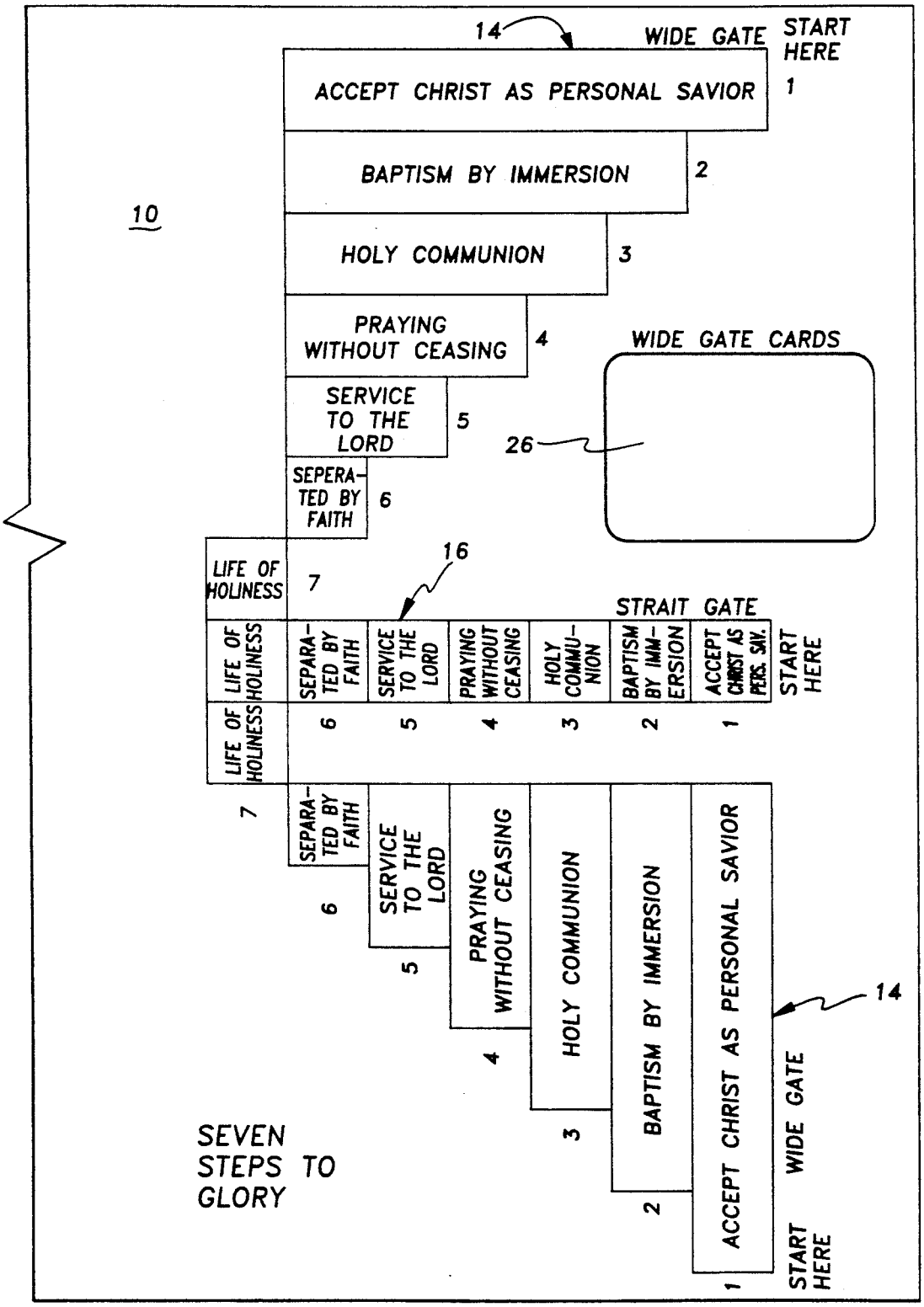

FIGS. 1A and 1B taken together show the game board 10 for the Bible Quiz Game, symmetrically arranged to enable up to four players to play the game. There are seven steps each layer must climb to reach a "Life of Holiness" step located adjacent the centrally located "Glory Circle" 12. Initially, each player elects whether to climb the seven steps located in the diagonal wide gate path 14 disposed at each corner of game board 10, or to climb the seven steps located in the strait gate path 16 disposed perpendicular to each side of game bard 10 so as to divide the game board into four equal sections. Once a gate path 14 or 16 has been elected, each player must stay within that gate path until the conclusion. Each of the corresponding steps 1 through 7 have the same label as shown in FIGS. 1A and 1B. The player reaching the "Glory Circle" 12 first is declared the winner. Generally, the strait gate path 16 requires a more extensive and detailed knowledge of the New King James version of the Bible than does the wide gate path 14.

To start the game, the players draw lots, shown as being three red marbles 18 and one black marble 20 contained within a pouch 22 in FIG. 3. The player who pulls out the black marble 20 from the pouch 22 will start first, and the rest of the players will take turns in a clockwise direction.

As shown in FIGS. 1A and 1B, game board 10 carries two decks of cards thereon, a strait gate deck 24 and a wide gate deck 26. Each deck 24, 26 includes 50 cards, which may be supplemented alternatively with a second deck of 50 cards. Each deck includes cards having biblical questions together with an indication as to where in the King James version of the Bible 28 the answers may be found, cards having negative accusations, at least two freeze cards, at least two mercy cards, and one draw lot card. Each of the cards include instructions as to whether to move up or down a specific number of steps or to remain in place depending upon whether a correct (C) or incorrect (I) answer has been given to a question, whether the player has been successful (S) or unsuccessful (U) in drawing a lot, or the severity of the negative accusation.

Representative examples of wide gate cards to be found in wide gate deck 26 are shown in FIG. 5. Similarly, representative examples of strait gate cards are when in FIG. 6. Normally the wide gate deck 26 includes 15 cards having biblical questions. and 30 cards having negative accusations, while the strait gate deck 24 includes 30 cards having biblical questions, and 15 cards having negative accusations. A player selecting a freeze card 30 may have the freeze card until needed to stop another player from moving from the seventh step into the "Glory Circle" 12.

Each player, when it is his or her turn, selects cards from the wide gate deck 26 or strait gate deck 24 depending upon the path 14 or 16 initially elected. The card selected will provide instruction indicating whether the player will move up or down the steps to glory or remain stationary. Each player at the beginning of the game receives a pair of shoes such as the pairs of shoes 32, 34, 36 and 38 shown in FIG. 2, to indicate the progress of each player on game board 10. The respective paris of shoes 32, 36 and 38 may have different configurations as shown and/or different colors.

Once a player reaches the seventh step (Life of Holiness) he or she must wait until his or her next turn and draw a successful lot before entering into the "Glory By Faith", and answers a question correctly and is instructed to move up two steps, the player must remain on the sixth step until he or she is instructed by a card to advance one step.

A freeze card 30 will stop a player who is standing in the "Life of Holiness" step and force him or her to lose a turn. When his or her next turn arrives the player must draw a card from the proper deck 24 or 26 and answer a question correctly. If the card instructs the player to advance, he or she must also draw a lot 20 successfully before moving forward.

It should be noted that while the cards making up the strait gate deck 24 include questions that are more difficult than those in the wide gate deck 26, the penalities are less severe.

While it will be apparent that the preferred embodiment of the invention herein disclosed is well calculated to fulfill the objects above-stated, it will be appreciated that the invention is susceptible to modifications, variation and change without departing from the proper scope or fair meaning of the subjoined claims.

I claim:

1. A Bible Quiz Game comprising:

a game board divided into four playing sections, each section including a wide gate path and a strait gate path, thereby enabling each player to select one of said wide gate path and said strait gate path prior to starting the game, each gate path including seven steps leading to a Circle of Glory;

a pair of shoes provided to each player to serve as a marker on the game board indicative of the progress of each player;

a pouch containing at least four individually identifiable lots, the selection of one of said lots indicating which player will start the game;

a strait deck of cards and a wide deck of cards, each deck being located on said game board, each deck of cards including cards having biblical questions and an indication as to where in a New King James version of the Bible the answer may be found, cards having negative accusations, at least two freeze cards, at least two mercy cards, and one draw lot card, each card including instructions as to the movement of the respective pair of shoes representing the player on the seven steps; and a New King James Version of the Bible for verifying answers given to questions found on the cards; whereby players sequentially select cards and follow instructions said cards so as to advance towards the Circle of Glory, the first player to advance to the Circle of Glory being declared the winner.

2. A Bible Quiz Game as in claim 1, said pairs of shoes each having an individual configuration.

3. A Bible Quiz Game as in claim 1, each pair of shoes having an individual coloring.

4. A Bible Quiz Game as in claim 2, each pair of shoes having an individual coloring.

5. A Bible Quiz Game as in claim 1, said lots comprising three red marbles and one black marble.

6. A Bible Quiz Game as in claim 2, said lots comprising three red marbles and one black marble.

7. A Bible Quiz Game as in claim 3, said lots comprising three red marbles and one black marble.

8. A Bible Quiz Game as in claim 4, said lots comprising three red marbles and one black marble.

9. A Bible Quiz Game as in claim 1, said cards including a freeze card whereby an opposing player may block immediate entry into the Circle of Glory.

10. A Bible Quiz Game as in claim 2, said cards including a freeze card whereby an opposing player may block immediate entry into the Circle of Glory.

11. A Bible Quiz Game as in claim 3, said cards including a freeze card whereby an opposing player may block immediate entry into the Circle of Glory.

12. A Bible Quiz Game as in claim 4, said cards including a freeze card whereby an opposing player may block immediate entry into the Circle of Glory.

13. A Bible Quiz Game as in claim 5, said cards including a freeze card whereby an opposing player may block immediate entry into the Circle of Glory.

14. A Bible Quiz Game as in claim 6, said cards including a freeze card whereby an opposing player may block immediate entry into the Circle of Glory.

15. A Bible Quiz Game as in claim 7, said cards including a freeze card whereby an opposing player may block immediate entry into the Circle of Glory.

16. A Bible Quiz Game as in claim 8, said cards including a freeze card whereby an opposing player may block immediate entry into the Circle of Glory.

* * * * *